United States Patent [19]

Leykamm et al.

[11] Patent Number: 4,590,782

[45] Date of Patent: May 27, 1986

[54] MAKING OF A BEVEL GEAR

[75] Inventors: Herbert Leykamm, Lauf; Siegfried Knabel, Nuremberg, both of Fed. Rep. of Germany

[73] Assignee: Kabel- und Metallwerke G. AG, Hanover, Fed. Rep. of Germany

[21] Appl. No.: 165,797

[22] Filed: Jul. 3, 1980

[30] Foreign Application Priority Data

Jul. 5, 1979 [DE] Fed. Rep. of Germany ..... 2927135

[51] Int. Cl.[4] ..... B21K 1/30

[52] U.S. Cl. ..... 72/354; 72/359

[58] Field of Search ..... 29/159.2; 72/354, 357, 72/358, 359, 360

[56] References Cited

U.S. PATENT DOCUMENTS 2,285,575 6/1942 Elbertz ..... 29/159.2

4,008,599 2/1977 Dohmann ..... 72/354

FOREIGN PATENT DOCUMENTS 645083 7/1962 Canada ..... 72/354

*Primary Examiner*—Lowell A. Larson

*Attorney, Agent, or Firm*—Ralf H. Siegemund

[57] ABSTRACT

A bevel gear is made by means of a die, a punch, and two concentrical counterpunches, one having a particularly contoured extension. A cylindrical blank, having a diameter not larger than the smallest bevel gear root circle, is inserted in the die; a portion is held by one counterpunch but reverse-extruded in part into the gap between that counterpunch and the advancing punch. A portion of the blank inserted into the interior of the die flows concurrently radially into the small-diameter portion of the die cavity. Subsequently, the reverse-extruded, tubular portion is forced back in parts by the second counterpunch, acting in the gap, to fill the large-diameter portion of the cavity. A tubular shaft extension may remain on the gear.

5 Claims, 4 Drawing Figures

3
4
13
1
4
3
1
15
12
5
5
6a
11
16
10
2
7
9
7
2
8
9
14
8
14a
14, 14a
2a

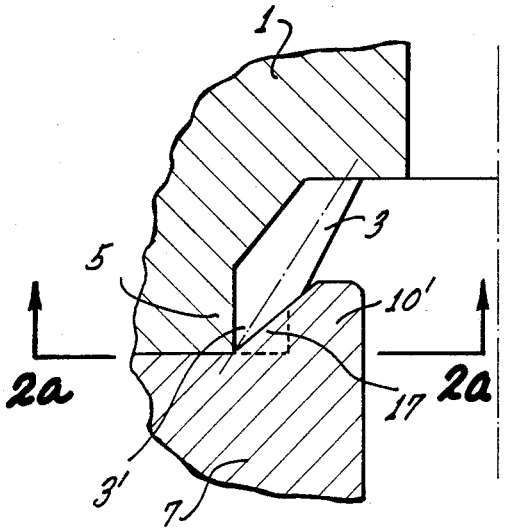
FIG. 2
FIG. 2a
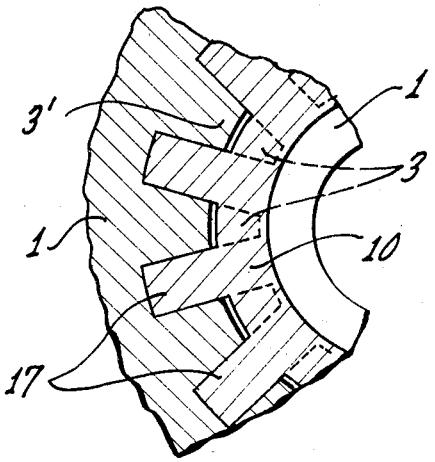
FIG. 3
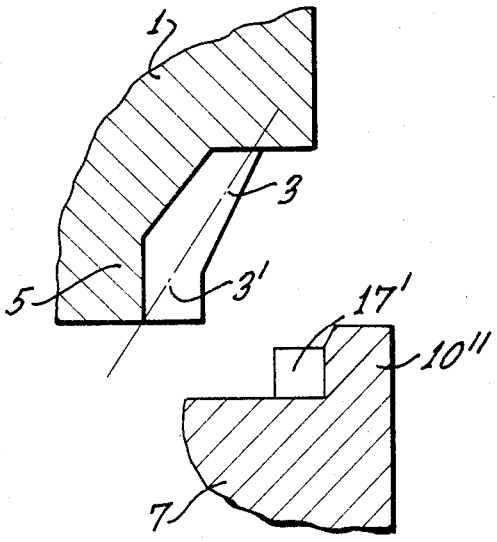

MAKING OF A BEVEL GEAR

BACKGROUND OF THE INVENTION

The present invention relates to the making of bevel gears.

Bevel gears are made, for example, by placing a cylindrical, metallic (e.g., steel) blank into a die having a cavity portion contoured in accordance with the "negative" of the gear to be made; further, a punch is used, coaxially received by a control sleeve or counterpunch, to force the blank into the die cavity for press-forming the gear. This kind of method is disclosed, for example, in German Pat. No. 24,46,413; see also U.S. Pat. Nos. 3,731,516 and 4,068,599. These prior art methods relate particularly to features to assure completely filling the small diameter portion of the die cavity without having to exert excessive pressure. U.S. Pat. No. 4,008,599, in particular, suggests the use of a punch whose outer diameter is approximately equal to the diameter of a circle defined by the intersection of the bottom of the die cavity with the pitch cone of the bevel gear grooves and ridges, at a tolerance not exceeding a 20-percent diameter difference. This patent discloses also a truncated cone projecting from the punch and matching a cone defined by the ridges of the bevel gear cavity. Since the diameter of the punch is a parameter for determining the diameter of the blank, it appears inevitable that the blank sits on the ridges. Consequently, the die will wear out at these parts. The methods as per these references are very satisfactory from a point of view of avoiding the making of incomplete gears; but the dies wear out rather rapidly.

DESCRIPTION OF THE INVENTION

It is an object of the present invention to provide a new and improved method of making a bevel gear and particularly a method which uses press working rather than machining, and under conditions which avoid undue wear and tear of the die.

It is a particular object of the invention to provide a new and improved one-step method of making a bevel gear, using simple cylindrical blanks, particularly blanks which will not sit on die ridges during the first phases of press working.

It is a specific object of the present invention to provide a new and improved method of and apparatus for making a bevel gear, using a die whose cavity is the "negative" of the gear to be made, and using further a punch concentrically received by a counterpunch.

In accordance with the preferred embodiment of the present invention, it is suggested to make a bevel gear by pressing a cylindrical blank in a die in such a way that the inserted portion flows radially into the small diameter portion of the die while the remainder of the blank is reverse-extruded, e.g., into a gap between a punch and a counterpunch. The reverse-extruded portion is subsequently press-formed, at least in parts, to flow into the large diameter portion of the bevel gear die. A portion of the reverse-extruded tubular portion may remain as a hollow, integral shaft. If a relatively long shaft is desired, the blank may have already a tubular extension. The blank should have a diameter that does not exceed the smallest root circle of the gear to be made so that the blank will not sit on any ridges of the die and still, complete fitting of the die is assured.

The method can be practiced with advantage by using a die—punch—counterpunch combination as per the specific object, but with a cylindrical gap between the punch and the counterpunch in which is held a sleeve, which actually could be regarded as a second counterpunch. In other words, one could deem the arrangement to be one of a punch and two concentric counterpunches. The punch acts on the blank while the principal counterpunch is advanced to hold a portion of the blank against radial expansion while the blank portion, sitting deeper in the cavity, is forced radially into the small-diameter cavity portion; concurrently the blank portion, which is held, is reverse-extruded into the gap between the punch, the principal counterpunch, and the relatively retracted second counterpunch or sleeve. Subsequently, that second counter-punch is advanced to force the reverse-extruded material back and into the large-diameter cavity portion, the principal counter-punch having been (or is being) temporarily retracted to open up that cavity portion. The length of effective stroke advance of the second counterpunch is selected, possibly adjustable, in accordance with the desired, length of the tubular shaft portion that will remain and extend from the large-diameter side of the bevel gear, following completion thereof.

The counterpunch has a particular extension which will penetrate deeply into the die cavity to ensure that, particularly in the initial stages, the small-diameter portion of the cavity will be completely filled. The entire process is, in fact, a one-step process because, following a completed advance of the die on one hand and of the punch-counterpunch combination on the other hand, the gear is completely formed. It is merely required to perform some finishing work and to remove a disk-shaped portion across the small-diameter portion of the gear.

The one-step operation is particulary ensured by permitting a relative, temporary retraction of the spring-biased counterpunch in relation to the punch by operation of material that has filled completely the small-diameter portion of the die and acts axially upon the counterpunch. This retraction opens up the large-diameter portion of the die cavity to be filled by the continual punch advance, and the then ensuing advance of the second counterpunch forces part of the reverse-extruded material back.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

FIG. 2 is a section view through a modified portion of the equipment of FIG. 1; and FIG. 3 is a section view of a further modification of an element shown in FIG. 2.

Proceeding now to the detailed description of the drawings, FIG. 1 shows a press tool or machine which includes generally an upper portion 1 and a lower portion 2. These designations are arbitrary and tied to the illustration. The press could well be worked upside down. Part 1 constitutes the die having a cavity 1*a* which is configured in accordance with the negative of a bevel gear to be made. The cavity is, thus, of an overall conical, or better, frustraconical configuration, but has ribs 3 which will form the grooves of the gear.

Figure 1:
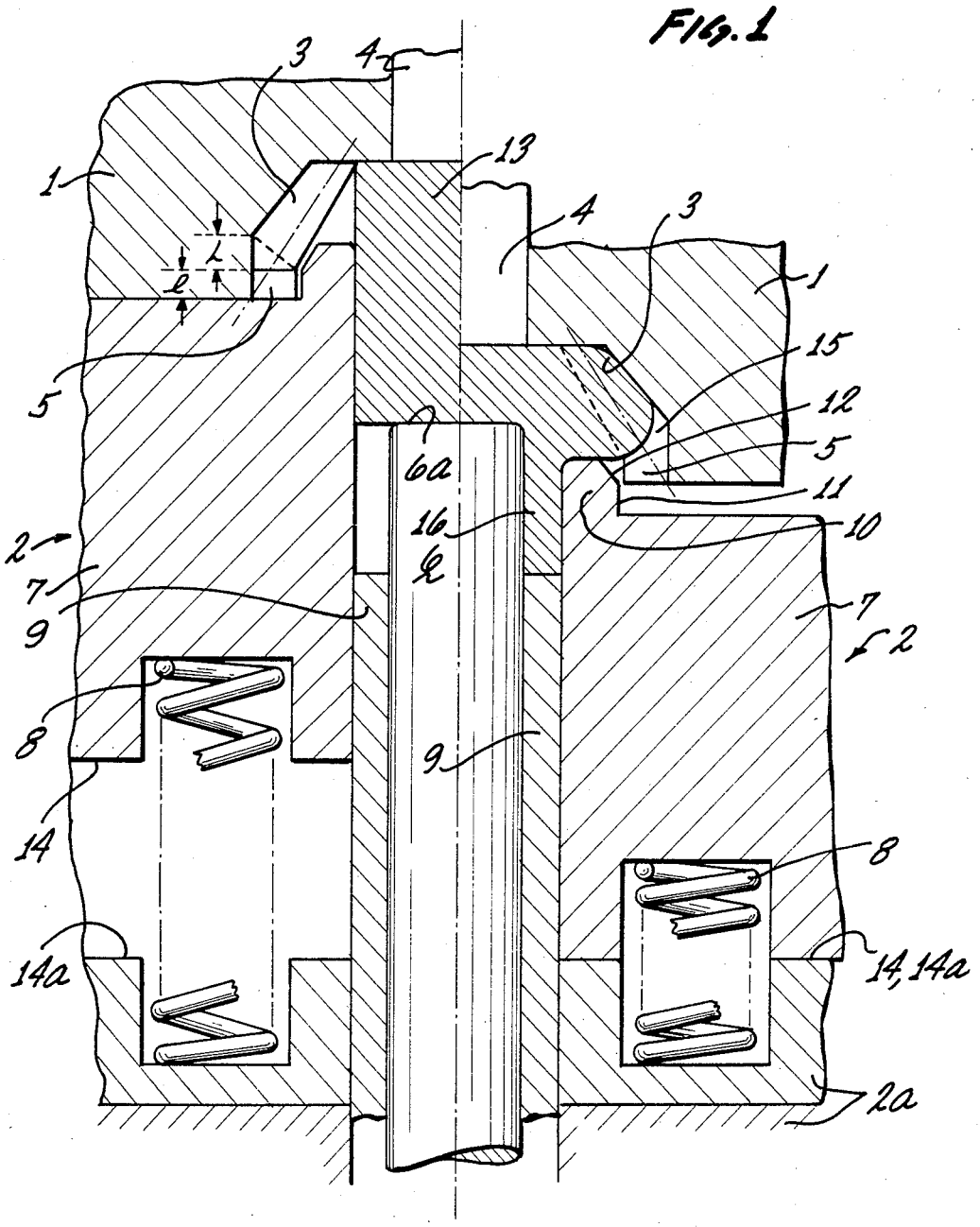
FIG. 1 is a section view of the interior of the equipment used for practicing the preferred embodiment of the present invention in accordance with the best mode thereof; the figure illustrates that equipment, being symmetrical, in a bisected manner, the left-hand side representing an operating state just prior to press forming, the right-hand side showing an intermediate state of the forming process.

The cavity has an extension 4 for receiving the ejector (not shown). On the other end, die cavity 1*a* has a cylindrical spline-like extension 5, into which also extend the ridges 3; the gearing is thus continued into that cylindrical portion. The axial length l of that portion 5 should be at least about equal to a length L, as defined by the geometry of the bevel gear and, particularly, by the groove's depth and the cone angle of the bevel.

Tool portion 2 is comprised of a press punch 6, being secured to tool body or member 2*a*. The first or principal counterpunch 7 is operatively connected to tool body 2*a* by means of springs 8 to be movable relative thereto and coaxially in relation to the punch 6 which is secured to body 2*a*.

Reference numeral 9 refers to a guide sleeve or second counterpunch 9 which is coaxially and concentrically interposed between punch 6 and the principal counterpunch 7. Counterpunch 9 is permitted to slide on the punch to a limited extent. The FIG. 1 shows the down-most position that counterpunch 9 can assume. It will move up with the punch from there.

Counterpunch 7 has an annular projection 10 which includes a cylindrical part 11 and a conically contoured tip part 12. The cylindrical part 11 has a diameter which is slightly less than the diameter of the circle defined by cylindrical ridge portions of ridges 3 in extension 5. The conical part 12 continues the cylindrical part, its cone angle being the same as the cone angle of the root cone of the bevel gear to be made.

Turning now specifically to the left-hand portion of FIG. 1, the process begins with the insertion of a solid cylindrical blank 13. The punch-counterpunch combination 2 has been advanced relative to the die (or vice versa) until the front end of the counterpunch 7 abuts die 1 so that a portion of the blank 13, including the end facing the punch, is inserted in the counterpunch, to be held therein against radial flow. Thus, the blank projects from the die cavity into annular space defined by the advanced and protracted counterpunch 7 which is lifted off body 2*a* by spring 8. Conversely, projection 10 extends into the die cavity. The position of counterpunch 9 is undefined; it may have been moved forward, but the forward position is not one of positive retention.

Press-working begins as tool parts 1 and 2 are now moved toward each other, but only punch 6 advances to act against the blank. The figure shows actually the die 1 in a displaced position. Dynamically, there is no difference; but it is convenient to describe the process by assuming die 1 to be stationary while the other parts are described in regard to movement relative to the die.

The counterpunch 7 is held on die 1, so that springs 8 begin to be compressed because punch 6 and frame, holder, or body 2*a*, advance in unison. The blank undergoes two deformations, affecting generally different portions thereof. The portion of the blank inside the die cavity, but outside the space bounded by the counterpunch, will flow radially into the die cavity, filling particularly the small-diameter portion thereof. Concurrently, the lower portion of blank 13 undergoes backward or reverse extrusion into the gap between punch 6 and counterpunch 7. The sleeve or counterpunch 9 will readily yield if necessary and retract, but only to a particular, possibly adjustable, stop position on the punch (as shown), thus limiting the axial length of the gap, as measured, down in relation to the front face 6*a* of punch 6.

The press forming continues until the small-diameter portion of the die cavity is filled, and the material begins to act upon the front end face of extension 10. The resulting force will tend to force the counterpunch 7 down, provided the expansion force of the material is sufficient to overcome the increased bias of spring 8. The press working continues in that the relative retraction of the extension 10 of the counterpunch 7 tends to free the large-diameter portion of the die cavity so that material can now flow also into that portion. In terms of relative volume, one may say that the extension 10 occupies space in the die cavity for most of the forming operation, to be filled with material only during the last stages of operation. The counterpunch 7 (having extension 10) will, in fact, lift off the die, and the extension will be retracted only after the major forming process including complete filling of the small- and median-diameter portions has been completed.

During all that time, the two surfaces 14*a* and 14 of body 2*a* and counterpunch 7 advance toward each other until abutting, as shown in the right-hand portion of FIG. 1. Earlier, concurrently or later, depending upon the adjusted stop position of counterpunch 9 on punch 6, the reverse extrusion (16) has stopped as the available gap between the parts 6, 7, and 9 is filled; counterpunch 9 will no longer yield but advance with the punch for completing the press-forming operation.

The intermediate operating state, as per the right-hand portion of FIG. 1, is defined and establishes the following condition. Counterpunch 7 is now rigidly coupled to body 2*a* and punch 6 as far as the relative movement of parts 1 and 2 against each other is concerned. On the other hand, die 1 is now spaced from counterpunch 7. Counterpunch 9 has begun, or is about to begin, to force the reverse-extruded hollow, tubular portion 16 back toward the die cavity.

The movement of parts 1 and 2 against each other continues; and now extension 10, coacting with punch 6, forces the material into all those portions of the die cavity which are not yet completely filled. Moreover, some of the material (16) which was back-extruded into the gap between the punch and the counterpunch, is, indeed, forced back into the die cavity by the sleeve or counterpunch 9; the front end 6*a* of punch 6 penetrates still deeper into the blank material in the central part of the die cavity, thereby producing a bore in the bevel gear being made. Any excess material will flow into extension 5 of the die cavity.

It should be noted that the bevel gear needs some finishing work of that part facing an open cavity portion throughout which is adjacent to extension 5 of the cavity. Moreover, a slight excess in blank material should be provided for to ensure that blank weight and volume tolerances will not result in an incomplete forming anywhere of the gear.

It can readily be seen that the relative dimensions, e.g., of counterpunch 9 and of its holding position on punch 6, permits selection of the length of a hollow shaft as an integral part of the bevel gear, extending from the large-diameter end of the gear. A portion of the reverse-extruded hollow sleeve 16 may remain as such to serve as hollow integral shaft on the large side of the bevel gear. This is a fortunate side effect of the process, in case such a shaft is desired. It is not necessary in principle because, as far as the inventive method proper is concerned, the reverse-extruded hollow serves as a temporary store of material to be forced later, at least in parts, into the large-diameter portion of the die cavity. Selection of a blank having an indent in the area engaged by the punch permits the forming of a still longer shaft. In other words, for purposes of back- or reverse-extruding a long hollow shaft, it may be advisable to use a blank resembling a cylindrical pot with a thick bottom (for forming the bevel gear), and reverse extrusion adds length to the already tubular portion of such a blank.

The blank 13 has a diameter which matches the smallest root circle of the bevel gear to be made. The blank should not be wider, so that this one end lodges directly in the small-diameter area of the gear. On the other hand, the diameter of the blank should not be much smaller as it may tend to kink.

As far as the extension 10 is concerned, it functions in the initial stages as a flow guide for the material, to ensure complete filling of the radially outermost and deepest regions in the die cavity. This extension is temporarily retracted when the filled in and overfilling material, as worked, lifts counterpunch 7 off the die 4. This opens up a direct radial path for material from the blank adjacent to the reverse-extruded portion 16 so that the material can completely fill the intermediate-diameter portions of the die cavity and can also begin to fill the large-diameter portion. In the final stages, the material which has flowed back and a little radially outwardly from extruded portion 16 will then be forced out further, radially, by the extension as it is, again, forced into the material; this occurs when punch and counterpunches all move in unison toward the final position.

FIGS. 2 and 2*a* show a modification of the counterpunch extension, denoted here as 10'. This extension has gear-like radial protrusions 17 which enter the space between the splineshaft-like ridge extensions 3' of the die. The outer diameter of these protrusions should still be a bit smaller than the "gearing" of the die, including particularly the ridges 3 and their extensions 3'. This feature makes certain that the outermost portions of the bevel gear die grooves fill completely with material before the material will flow generally axially in a reverse manner into portion 5.

FIG. 3 shows a modification of FIG. 2, the extension 10'' is of overall cylindrical configuration from which extend the gear-like teeth 17'. The extension 10'' will not penetrate as deeply into the die cavity. However, it can readily be seen that, by contouring the periphery of the extension from the counterpunch 7, one can obtain different types and degrees of control as regards the axial-radial flow of the material, initially as well as upon gradual retraction of the counterpunch.

Returning now to the method description in general, the parts 1 and 2 are retracted from each other in each instance, and the bevel gear is ejected by an appropriate ejector acting from and through bore 4. The gear still includes material across the small-diameter portion, which is removed by punching or stamping in order to obtain a hollow interior that extends from axial end to axial end, to complete the throughbore in the gear.

The invention is not limited to the embodiments described above; but all changes and modifications thereof, not constituting departures from the spirit and scope of the invention, are intended to be included.

We claim:

1. Apparatus for making bevel gear, comprising:

a die having a cavity for forming a bevel gear;

a punch disposed for relative advance to and into the die cavity;

a first counterpunch coaxially disposed to the punch and having an annular extension into the cavity, there being a gap between the first counterpunch and the punch, said extension including a cylindrical part, being slightly smaller than any radially adjacent innermost diameter dimension of the die cavity for a disposition of abutment of the first counterpunch and the die; and a second counterpunch disposed in said gap being movable in relation to the punch, but also advancing with the punch.

2. Apparatus for making bevel gear, comprising:

a die having a cavity for forming a bevel gear having a cylindrical, spline-shaft-type extension;

a punch disposed for relative advance to and into the die cavity;

a first counterpunch coaxially disposed to the punch, there being a gap between the first counterpunch and the punch; and a second counterpunch disposed in said gap being movable in relation to the punch, but also advancing with the punch.

3. Apparatus as in claim 2, said first counterpunch having an annular extension into the cavity.

4. Apparatus as in claim 3, said extension having a conical tip, the cone angle being approximately equal to a cone angle of the root cone of the bevel gear to be made and as defined by the cavity and its contour.

5. Apparatus as in claim 2, said extension having radial, gear-like teeth, insertable in grooves of the spline-shaft-like extension as defined by extensions of ridges of the die cavity.

* * * * *